US010725426B2

(12) United States Patent
Kumagai

(10) Patent No.: US 10,725,426 B2
(45) Date of Patent: Jul. 28, 2020

(54) IMAGE FORMING APPARATUS CONTROLLING ACCESS TO TONER CONTAINERS

(71) Applicant: CANON KABUSHIKI KAISHA, Tokyo (JP)

(72) Inventor: Kenzo Kumagai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/434,629

(22) Filed: Jun. 7, 2019

(65) Prior Publication Data

US 2019/0391525 A1 Dec. 26, 2019

(30) Foreign Application Priority Data

Jun. 21, 2018 (JP) ..... 2018-118260

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
USPC ..... 399/119
See application file for complete search history.

(56) References Cited

U.S. PATENT DOCUMENTS

| | | | | |
|---|---|---|---|---|
| 6,560,416 | B2 | 5/2003 | Fischer | |
| 8,509,651 | B2 | 8/2013 | Tsukijima | |
| 2011/0058825 | A1* | 3/2011 | Tsukijima | G03G 21/1633 399/27 |
| 2013/0071139 | A1* | 3/2013 | Fukao | G03G 21/1633 399/110 |
| 2018/0157203 | A1* | 6/2018 | Mori | G03G 21/1633 |

FOREIGN PATENT DOCUMENTS

JP 2011-059296 A 3/2011

* cited by examiner

*Primary Examiner* — Quana Grainger
(74) *Attorney, Agent, or Firm* — Venable LLP

(57) ABSTRACT

An image forming apparatus includes developer accommodating containers, mounting portions for the respective containers, a switching portion, and a manually operable cover. In a stand-by state after exchange of one of the developer accommodating containers is prompted, the switching portion switches a state of the container from a non-accessible state to an accessible state with opening of the cover. In a case that a jam occurrence signal is ON after the exchange of the developer accommodating container mounted in the mounting portion is prompted, the switching portion maintains the non-accessible state without switching from the non-accessible state to the accessible state at the time of the opening of the cover.

10 Claims, 9 Drawing Sheets

IMAGE FORMING APPARATUS CONTROLLING ACCESS TO TONER CONTAINERS

FIELD OF THE INVENTION AND RELATED ART

The present invention relates to an image forming apparatus which employs an electrophotographic recording method, an electrostatic recording method, or the like, in particular, those in which a developer container is removably installable.

An electrophotographic image forming apparatus has been widely used as a copying machine, a printer, a plotter, a facsimile machine, a multifunction machine having two or more functions of the preceding machines, and the like. In the field of these image forming apparatuses, microscopic particles of toner are used as one of the ingredients of the developer for image formation. Further, in the field of an image forming apparatus which uses toner, those structured so that a developer storage container which is filled with toner (which hereafter may be referred to simply as toner container), and is removably installable in the main assembly of an image forming apparatus, have been widely used.

An image forming apparatus of one of the above described types is provided with a toner hopper. A toner hopper temporarily stores the toner supplied from a toner container installed in the main assembly of an image forming apparatus, and is capable of supplying a developing apparatus with the toner stored therein. It is provided with a sensor (residual amount detection sensor) for detecting the amount of the toner remaining in the hopper. As a controlling portion, with which an image forming apparatus is provided, detects the residual amount of toner in the toner hopper, with the use of the residual amount detection sensor, it supplies the toner hopper with the toner from the toner container. If a toner container reduces in the amount of the toner remaining therein, and therefore, it becomes impossible for the toner hopper to be supplied with a preset amount of toner from the toner container, the controlling portion displays a message (which hereafter may be referred to as replacement message) which prompts a user to replace the toner container in the main assembly of an image forming apparatus, on the monitor of the image forming apparatus, in order to inform a user that it has become time for replacing the toner container in the main assembly.

There has been proposed an image forming apparatus, which is capable of preventing the occurrence of an incidence that a toner container in the main assembly of an image forming apparatus, which has not reached a point in time at which it has to be replaced, is accidentally replaced (U.S. Pat. No. 6,560,416). This image forming apparatus is provided with a cover which covers the entrance of the main assembly of the image forming apparatus, through which a toner container is to be installed into the main assembly. It is structured so that the cover which corresponds to the toner container which has run out of toner, and therefore, is to be replaced, automatically opens. This image forming apparatus, however, suffers from the following problem: since the apparatus is structured so that its cover automatically opens as a toner container runs out of toner, it is possible that the cover will be left open. Thus, there has been proposed an image forming apparatus of another type, which is provided with inside covers for exposing or covering the entrances for the toner container compartments, in addition to the above-mentioned exterior cover (front cover, for example) (Japanese Laid-open Patent Application No. 2011-59296). This image forming apparatus is structured so that as the front cover is opened by a user, the inside cover, which corresponds to the toner container which is to be replaced, automatically opens. That is, unless the front cover is opened, the inside covers do not open, and therefore, it does not occur that one or more of the interior covers are left open. Therefore, the toner container which ran out of toner can be properly replaced.

However, the image forming apparatus disclosed in Japanese Laid-open Patent Application No. 2011-59296, which was described above, suffers from the following problem. That is, as its front cover is opened, its inside cover which corresponds to the toner container which is to be replaced automatically opens. Therefore, it is possible for the image forming apparatus to suffer from the following problem. For example, it is possible that an image forming apparatus such as the one disclosed in Japanese Laid-open Patent Application No. 2011-59296 will be structured so that the front cover doubles as another component, for example, the cover for a conveyance unit. In such a case, it is possible that as a user opens the front cover to deal with a paper jam, for example, the inside cover for the compartment for any of the toner containers which are out of toner will open with unintended timing, making it necessary to close the inside cover. That is, as a user opens the front cover to deal with a paper jam, the user may have to close the inside cover which unexpectedly opened. In other words, it is possible that Japanese Laid-open Patent Application No. 2011-59296 will increase an image forming apparatus in the number of operational steps, and therefore, will make the apparatus unnecessarily complicated in operation.

SUMMARY OF THE INVENTION

Therefore, the primary object of the present invention is to provide an image forming apparatus which does not require the operation for closing the inside cover(s) which automatically opens when the front cover of the apparatus is opened during any of the other operations than the operation for replacing the developer storage container, being therefore substantially less complicated in operation than any conventional image forming apparatus.

According to an aspect of the present invention, there is provided an image forming apparatus comprising a plurality of developer accommodating containers including a chromatic developer accommodating container and a black developer accommodating container; a plurality of mounting portions configured to mount said developer accommodating containers, respectively; an image forming portion configured to form an image on a recording material; a switching portion configured to switch a state between a first state in which said developer accommodating containers mounted in said mounting portions are capable of being dismounted and a second state in which said developer accommodating containers are not capable of being dismounted; and a manually openable and closable cover provided on an outside of said image forming apparatus; wherein said plurality of mounting portions become capable of being accessed by opening of said cover, and i) in a stand-by state in which said apparatus is waiting for input of an image formation signal after exchange of said developer accommodating container mounted in said mounting portion is prompted, said switching portion switches the state from the second state to the first state with an opening operation of said cover, and ii) in a case that a jam occurrence signal is ON after the exchange of said developer accommodating container mounted in said mounting portion is prompted, said switching portion maintains the second state without switching from the second state to the first state with the opening of said cover.

Further features of the present invention will become apparent from the following description of exemplary embodiments with reference to the attached drawings.

DESCRIPTION OF THE EMBODIMENTS

<Embodiment 1>

Next, the first embodiment of the present invention is described with reference to FIGS. 1-6. By the way, the image forming apparatus in this embodiment is a full-color printer of the so-called tandem type. However, the application of the present invention is not limited to an image forming apparatus of the tandem type. That is, the present invention is also applicable to an image forming apparatus of a type other than the tandem type. Further, the application of the present image is not limited to a full-color printer. That is, the present invention is also applicable to a monochromatic image forming apparatus as well as a black-and-while image forming apparatus.

Figure 1:
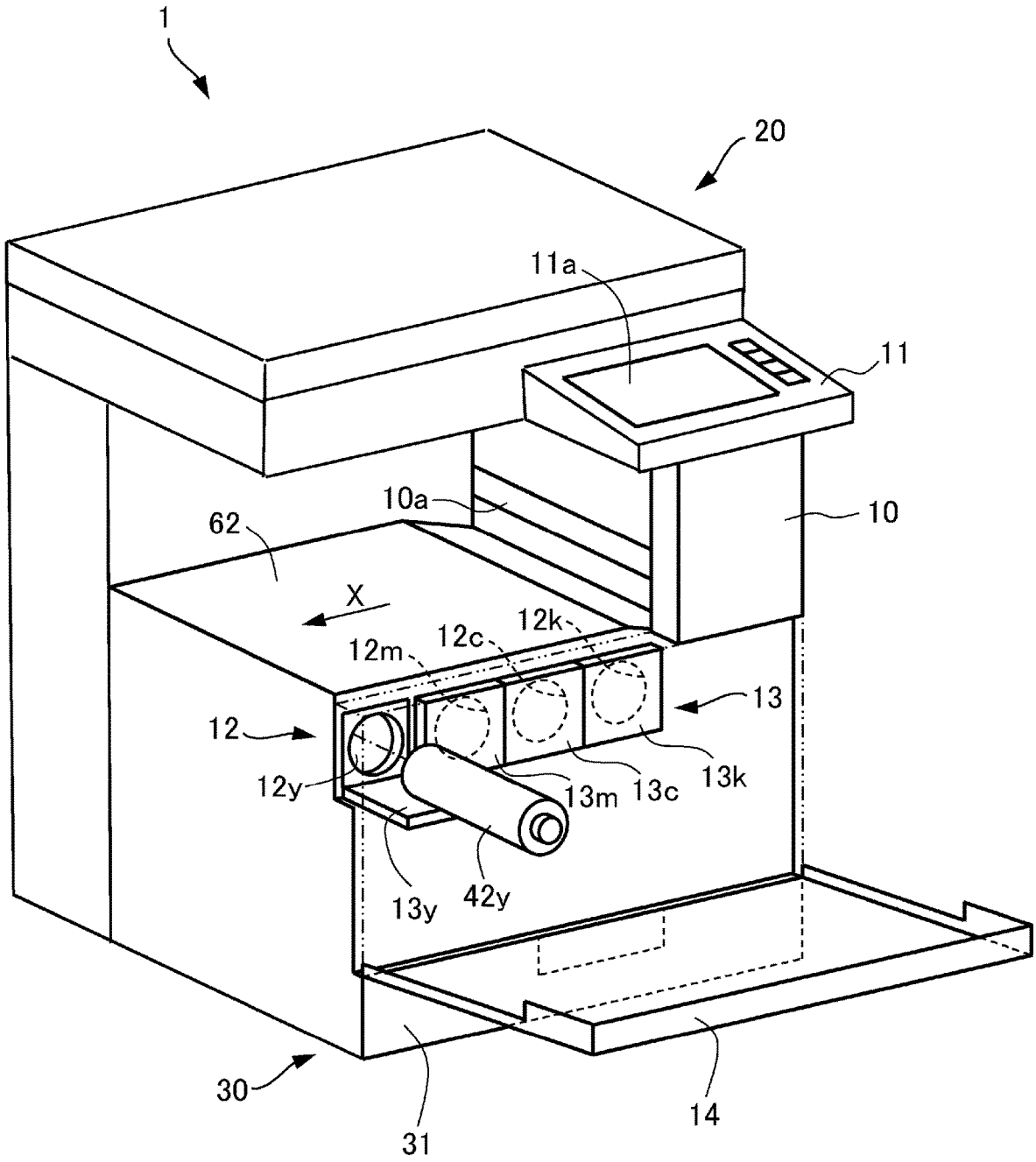
FIG. 1 is a perspective view of the image forming apparatus in the first embodiment of the present invention, which shows the general structure of the apparatus.
Figure 2:
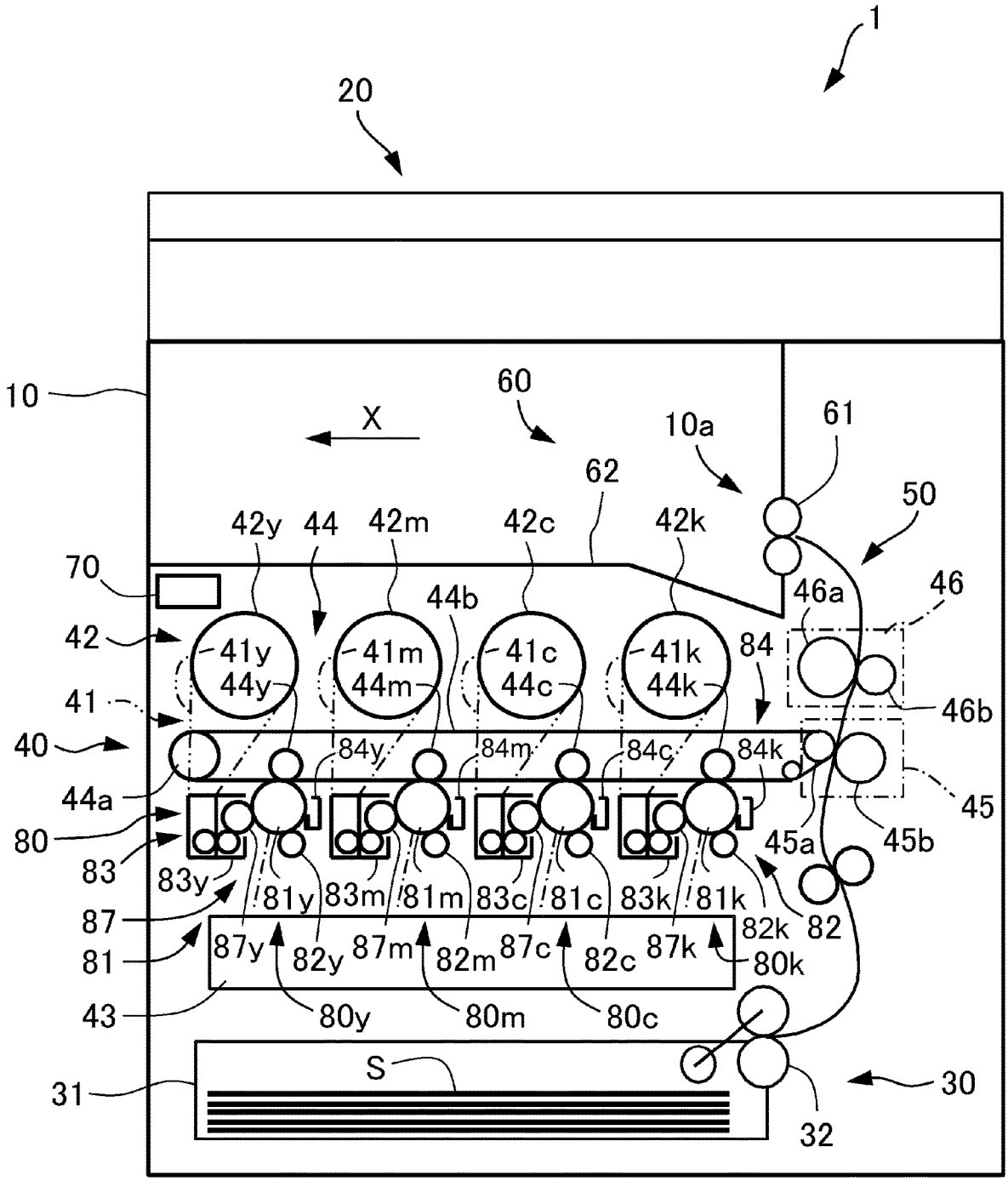
FIG. 2 is a schematic sectional view of the image forming apparatus in the first embodiment, which also shows the general structure the image forming apparatus.

Referring to FIGS. 1 and 2, the image forming apparatus 1 is provided with an apparatus main assembly 10. The apparatus main assembly 10 is provided with a control portion 11, which is a part of the top-front portion of the main assembly 10. The controlling portion 11 is provided with a touch panel 11*a* (display portion; inputting portion) which is touchable to choose an operation to be carried out by the apparatus 1. The control panel 11*a* is in connection to the control portion 70 (FIG. 3), which is in control of the contents to be displayed, and also, through which information can be inputted from external sources.

Referring to FIG. 2, the apparatus main assembly 10 is provided with an image reading portion 20, a sheet feeding-conveying portion 50, a sheet discharging portion 60, and the control portion 70. By the way, a sheet S of recording medium is a medium across which a toner image is formable. Specific examples of recording medium are ordinary paper, a sheet of resinous substance which can be used as a replacement for a sheet of ordinary paper, a sheet of card-stock, a sheet of film for an overhead projector, and the like.

The image reading apparatus 20 is on the top side of the apparatus main assembly 10. It is provided with an unshown piece of platen glass as an original placement plate, an unshown light source which sheds light upon an original on the platen glass, and an unshown image sensor which converts the light deflected by the image on the platen, into digital signals. The sheet conveying portion 30 is on the bottom side of the apparatus main assembly 10. It is provided with a sheet cassette 31 which can store multiple sheets S of recording medium in layers, and a feed roller 32. It delivers the sheets stored in the cassette 31, to the image forming portion 40.

Figure 3:
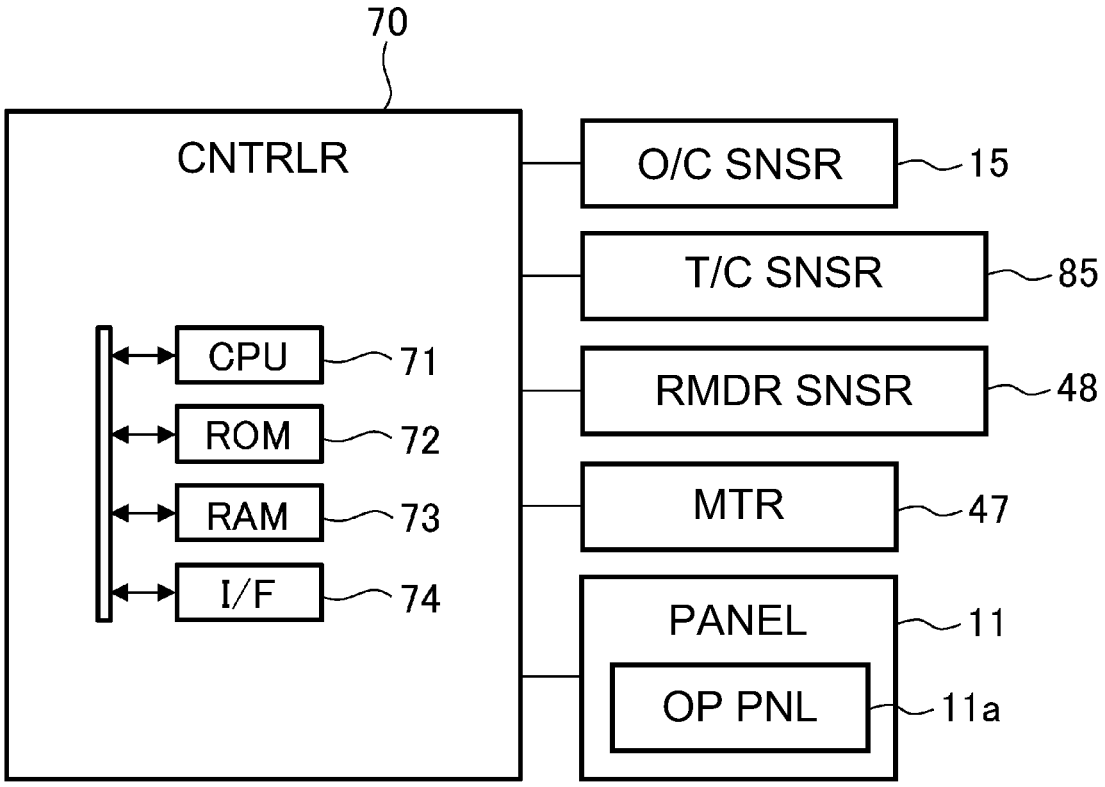
FIG. 3 is a block diagram of the control system of the image forming apparatus in the first embodiment.

The image forming portion 40 has an image formation unit 80, a toner hopper 41, a toner container 42 (developer container), a laser scanner 43, an intermediary transfer unit 44, a secondary transferring portion 45, and a fixing apparatus 46. It is capable of forming an image on a sheet S of recording medium, based on the information of the image to be formed. By the way, the image forming apparatus 1 in this embodiment is a full-color image forming apparatus. It has four image formation units 80*y*, 80*m*, 80*c* and 80*k*, which correspond to yellow (y), magenta (m), cyan (c) and black (k) colors, respectively, and are the same in structure. It has also the four toner hoppers 41*y*, 41*m*, 41*c* and 41*k*. It is capable of holding four toner containers 42*y*, 42*m*, 42*c* and 42*k*, which also correspond to yellow (y), magenta (m), cyan (c) and black (k) colors, respectively, and are the same in structure. Therefore, in a case where one of the structural components of the four image forming portions 40 in FIG. 2 is the same in structure as another in FIG. 2, the two are given the same numerical referential code. However, if the two are the same in structure, but are different in the color of the monochromatic images they form, they are given two different suffixes, one for one. In FIG. 3 and thereafter, the suffixes which represent color may not be shown.

The toner containers 42*y*, 42*m*, 42*c* and 42*k* are capable of storing developer. They are positioned above the image formation units 80*y*, 80*m*, 80*c* and 80*k*, respectively, with the placement of the toner hoppers 41*y*, 41*m*, 41*c* and 41*k* between the toner containers and image formation units, one for one. The toner containers 42*y*, 42*m*, 42*c* and 42*k* are removably installable in the apparatus main assembly 10 in such manner that they correspond in position to the cylindrical compartments 12*y*, 12*m*, 12*c* and 12*k* for the toner containers 42*y*, 42*m*, 42*c* and 43*k*, with which the apparatus main assembly 10 is provided. Each of the toner containers 42*y*, 42*m*, 42*c* and 42*k* is a cylindrical bottle, one of the lengthwise ends of which is the toner outlet. It is provided an internal spiral rib which is protrusive from the inward surface of the cylindrical bottle. As the toner container 42 is rotated, the rib conveys the toner in the bottle, to the toner outlet. Each toner container 42 is in connection to a supply motor 47 (FIG. 3). As the supply motor 47 is driven, the toner container 42 rotates, and discharges toner therein. In this embodiment, the toner used by the image forming apparatus 1 is roughly 6 μm in average particle diameter. It was obtained by pulverizing the solid mass obtained by mixing resinous binder, primary component of which is polyester, and pigments.

Referring to FIG. 1, the front portion of the apparatus main assembly 10 is provided with the inside covers 13*y*, 13*m*, 13*c* and 13*k* (first covers), which can be opened or closed, and are disposed so that they correspond in position to the cylindrical compartments 12*y*, 12*m*, 12*c* and 12*k*. The apparatus main assembly 10 is structured so that when the inside cover 13*y*, for example, is open, the toner container 42*y* is removably installable into the apparatus main assembly 10, from the front side of the apparatus. Similarly, when the inside covers 13*m*, 13*c* and 13*k* are open, the toner containers 42*m*, 42*c* and 42*k* are installable into the apparatus main assembly 10, or uninstalled from the cylindrical compartment 12, from the front side of the apparatus main assembly 10. That is, each inside cover 13 can be put in an open state in which a toner container 42 is removably installable in the cylindrical compartment 12 for a toner container, or a closed state in which a toner container 42 cannot be installed into, or uninstalled from, the cylindrical compartment 12. Further, the four compartments 12 for the toner containers 42 for the yellow (y), magenta (m), cyan (c) and black (k) toners, one for one, and the four inside covers 13 for the four compartments 12, one for one, are the same in structure. By the way, the detailed structure of the inside cover 13 will be given later.

Figure 4:
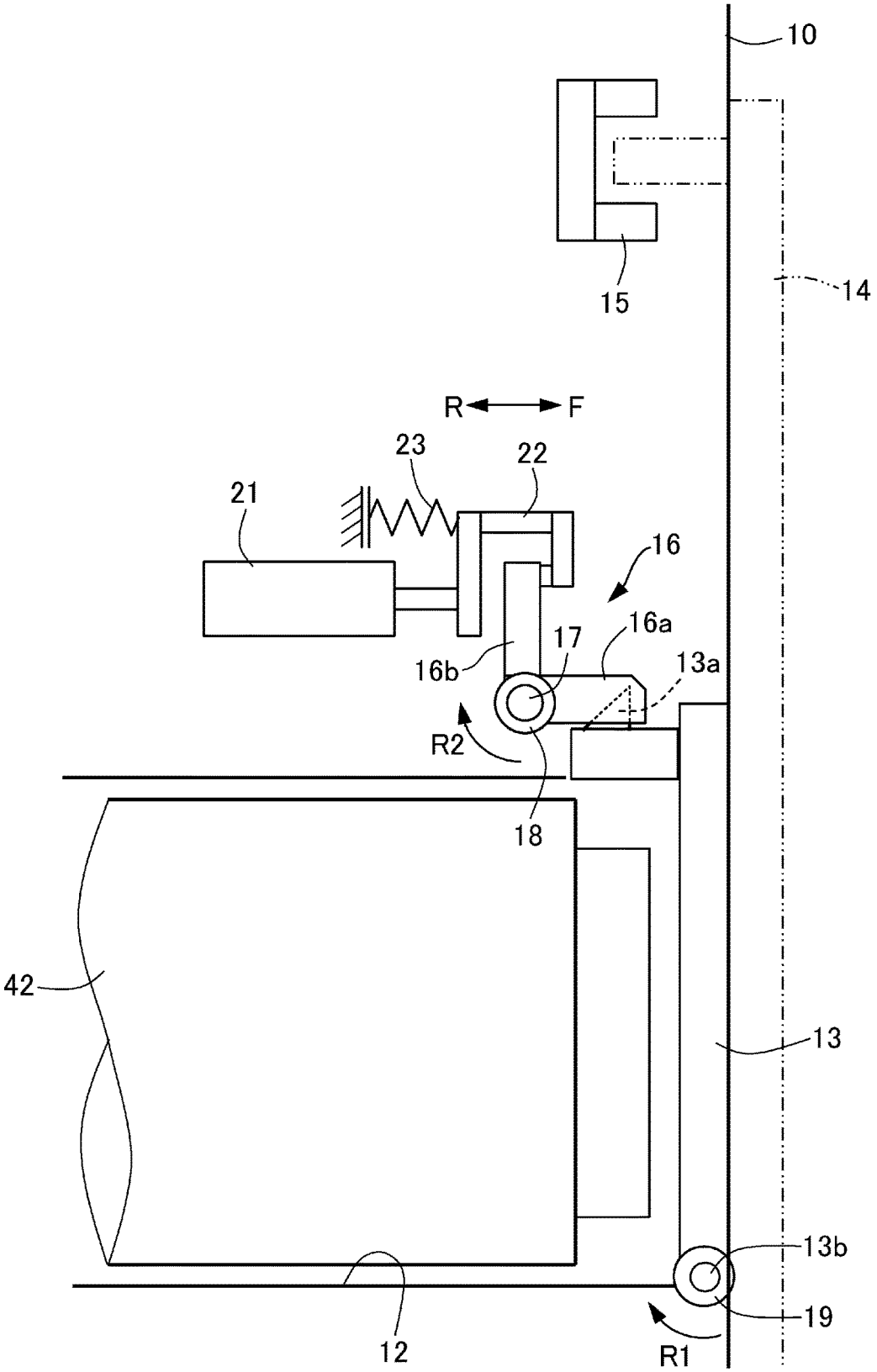
FIG. 4 is a schematic side view of one of the inside covers of the image forming apparatus in the first embodiment, when the front cover of the apparatus is remaining closed.

The front portion of the apparatus main assembly 10 is provided with the front cover 14 (second cover), which can be pivotally moved frontward or rearward to be opened or closed, respectively. The front cover 14 can be opened into an open state in which it exposes the inside covers 13 in such a manner that each inside cover 13 can be opened to removably install a toner container 42 into the corresponding cylindrical compartment 12, or a closed state in which it shields the inside cover 13 in such a manner that the toner container 42 cannot be installed into, or uninstalled from, the cylindrical compartment 12 for the toner container. Referring again to FIGS. 1 and 2, the front cover 14 regulates the toner container 42, developing apparatus 83, intermediary transfer belt 44*b* in their frontward movement. Further, the front cover 14 is provided with a sensor 15 (means for detecting whether front cover 14 is open or closed) for detecting the state of the front cover 14 (FIG. 4).

Referring to FIG. 2, the image formation unit 80 has: photosensitive drums 81*y*, 81*m*, 81*c* and 81*k* for forming a toner image; charge rollers 82*y*, 82*m*, 82*c* and 82*k*; developing apparatuses 83*y*, 83*m*, 83*c* and 83*k*, and cleaning blades 84*y*, 84*m*, 84*c* and 84*k*, respectively. In this embodiment, the image formation unit 80 is removably installable in the apparatus main assembly 10. Further, the photosensitive drums 81*y*, 81*m*, 81*c* and 81 are the same in structure. The charge rollers 82*y*, 82*m*, 82*c* and 82*k* are the same in structure. The developing apparatuses 83*y*, 83*m*, 83*c* and 83*k* are the same in structure. The cleaning blade 84*y*, 84*m*, 84*c* and 84*k* are the same in structure. Further, development sleeves 87*y*, 87*m*, 87*c* and 87*k*, which will be described later, also are the same in structure.

The photosensitive drum 81 is rotated by an unshown drum motor. During an image forming operation, it rotates while bearing an electrostatic latent image formed in accordance with the information of an image to be formed. The charge roller 82 charges the surface of the photosensitive drum 81 by being placed in contact with the peripheral surface of the photosensitive drum 81. The developing apparatus 83 has a development sleeve 87 which is rotatably attached to a development container. It develops an electrostatic latent image formed on the peripheral surface of the photosensitive drum 81, with the use of developer. In the developing apparatus 83, two-component developer, which is a mixture of nonmagnetic toner and magnetic carrier, is stored. It is structured so that toner is supplied thereto, from the toner container 42 filled with toner, by way of the toner hopper 41.

A part of the bottom portion of the developing apparatus 83 is provided with a toner density sensor 85 (residual amount detecting means) (FIG. 3). The toner density sensor 85 is an inductance sensor, for example. It is capable of detecting the toner density in the developing apparatus 83. It transmits the results of its detection to the control portion 70. In a case where the toner density detected by the toner density sensor 85 is no higher than the target level, the control portion 70 drives the supply motor 47 (FIG. 3) to deliver toner to the developing apparatus 83 from the toner container 42. The toner density sensor 85 is capable of detecting information regarding the remaining amount of toner in the toner container 42. The method employed in this embodiment to detect the residual amount of developer in the toner container 42 by the toner density sensor 85 is described later.

The cleaning blade 84 is disposed in contact with the peripheral surface of the photosensitive drum 81. It removes the developer remaining on the peripheral surface of the photosensitive drum 81 after the primary transfer. The cleaning blade 84 is formed of urethane rubber, for example. It is supported by an unshown metallic supporting plate by being attached to the supporting plate. The laser scanner 43 forms an electrostatic latent image on the peripheral surface of the photosensitive drum 81, by exposing the peripheral surface of the photosensitive drum 81 charged by the charge roller 82.

The intermediary transfer unit 44 is disposed above the image formation unit 80. It is provided with multiple rollers, more specifically, a driving roller 44*a*, an unshown idler roller, four primary transfer rollers 44*y*, 44*m*, 44*c* and 44*k*, and an intermediary transfer belt 44*b*. The primary transfer rollers 44*y*, 44*m*, 44*c* and 44*k* are disposed so that they oppose the photosensitive drums 81*y*, 81*m*, 81 and 81*k*, respectively. They are in contact with the intermediary transfer belt 44*b*.

The intermediary transfer belt 44*b* is provided with no less than a preset amount of tension even while it is not driven. The developing apparatus 83 is not structured to cause the intermediary transfer belt 44*b* to be placed in contact with, or separated from, the photosensitive drums 81*y*, 81*m*, 81*c* and 81*k*. That is, the developing apparatus 83 is structured so that the intermediary transfer belt 44*b* always remains in contact with the photosensitive drums 81*y*, 81*m*, 81*c* and 81*k*. As positive transfer bias is applied to the intermediary transfer belt 44*b* by the primary transfer rollers 44*y*, 44*m*, 44*c* and 44*k*, the four toner images on the photosensitive drums 81*y*, 81*m*, 81*c* and 81*k*, which are negative in polarity, are sequentially transferred in layers onto the intermediary transfer belt 44*b*. Consequently, the intermediary transfer belt 44*b* moves, bearing a full-color toner image obtained by developing the electrostatic images on the peripheral surfaces of the photosensitive drums 81*y*, 81*m*, 81*c* and 81*k*.

The secondary transferring portion 45 has a secondary transfer inside roller 45*a* and a secondary transfer outside roller 45*b*. As secondary transfer bias, which is positive in polarity, is applied to the secondary transfer outside roller 45*b*, the full-color image formed on the intermediary transfer belt 44*b* is transferred onto a sheet S of recording medium. By the way, the secondary transfer inside roller 45*a* is disposed on the inward side of a loop (belt loop) which the intermediary transfer belt 44*b* forms. It supports the intermediary transfer belt 44*b* and keeps the belt 44*b* tensioned. The secondary transfer outside roller 45*b* is positioned so that it opposes the secondary transfer inside roller 45*a*, pinching the intermediary transfer belt 44*b* between itself and the secondary transfer inside roller 45*a*.

The fixing apparatus 46 is provided with a fixation roller 46*a* and a pressure roller 46*b*. As a sheet S of recording medium, onto which a toner image has just been transferred, is conveyed through the fixing apparatus 46 while remaining sandwiched between the fixation roller 46*a* and pressure roller 46*b*, the toner image, which has just been transferred onto the sheet S, is heated and pressed. Consequently, the toner image becomes fixed to the sheet S. The fixing apparatus 46 is not an integral part of the apparatus main assembly 10, and is removably installable in the apparatus main assembly 10. The sheet conveying portion 50 conveys a sheet S of recording medium, which is delivered to the sheet conveying portion 50 from the sheet feeding portion 30, from the image forming portion 40 to the sheet discharging portion 60. The sheet discharging portion 60 has: a pair of discharge rollers 61 disposed on the downstream side of the sheet conveying portion 50; and a delivery tray 62 disposed on the downstream side of the pair of discharge rollers 61. The delivery tray 62 is of the so-called "face-down" type. As a sheet S is discharged from the sheet outlet 10*a*, it is laid upon the preceding sheets S in the delivery tray 62.

Referring to FIG. 3, the control portion 70 is a computer. It comprises a CPU 71, a ROM 72 in which the programs for controlling the various portions of the image forming apparatus 1 are stored, a RAM 73 in which data are temporarily stored, and an input/output circuit (I/F) which exchanges signals with external devices. The control portion 70 is in connection to the image reading portion 20, sheet feeding portion 30, image forming portion 40, sheet conveying portion 50, control panel portion 11, opening/closing sensor 15, toner density sensor 85, supply motor 47, etc., through the input/output circuit 74. Not only does it exchange signals with preceding portions, but also, controls them in their operation. Further, the control portion 70 can control the image forming apparatus 1 in response to the commands from unshown computers which are in connection to the apparatus main assembly 10, and also, in response to the instructions (commands) inputted by a user through the control panel portion 11. Moreover, the control portion 70 functions as a paper jam detecting means which is capable of detecting the occurrence of a paper jam in the sheet passage. In this embodiment, the paper jam detecting means is assumed to be able to detect at least the paper jam which occurred in the sheet conveyance passage while the sheet conveyance passage is remaining covered by the closed front cover 14.

During an image forming operation, the CPU 71 delivers toner from the toner container 42 to the developing apparatus 83 by rotationally driving the supply motor 47, in response to the toner density detected by the toner density sensor 85, and also, in response to the density of the developed image. In a case where the toner density level detected by the toner density sensor 85 is no more than a preset value (threshold value) for the toner density, even though the supply motor 47 is being continuously driven for a threshold number of times to determine whether or not there is toner in the toner container 42, the control portion 70 determines that the toner container 42 is out of toner, and stores "1" which indicates the presence of no toner, in a variable Tempty which indicates whether or not the toner container 42 is out of toner. That is, the toner density sensor 85 can detect the toner density of the developer in the developing apparatus 83.

In this embodiment, in a case where it is determined that any of the three toner containers 42 for yellow, magenta, and cyan toners, one for one, is out of toner, the control portion 70 puts the image forming apparatus 1 in the monochromatic mode (colorless mode) which allows the image forming apparatus 1 to form only monochromatic images. On the other hand, if it is determined that the toner container 42 for black toner is out of toner, the control portion 70 puts the image forming apparatus 1 in the out-of-toner mode which does not allow the image forming apparatus 1 to form any image. That is, in this embodiment, in a case where at least one of the color toner containers, that is, toner containers other than the black toner container, is no more than a preset value, in the amount of residual toner, the control portion 70 makes the image forming apparatus 1 operate in such a monochromatic mode that is for forming an image with the use of only black toner.

The control portion 70 carries out an image forming operation based on the information provided by an image formation job assigned to the image forming apparatus 1. In this embodiment, an "image formation job" means an operational sequence, such as the following one, which is to be carried out in response to print command signals (image formation command signals). More concretely, it means the so-called printing operation, that is, the operational sequence from the pre-rotation period (preparatory operation for image formation) which starts after the reception of print command signals (inputting of image formation job), to the post-rotation period (operation to be carried after completion of image formation). It includes the periods in which an image is actually formed, and sheet interval periods (periods in which no image is formed).

Next, the image forming operation to be carried out by the image forming apparatus 1 structured as described above is described. Referring to FIG. 2, as an image forming operation is started, first, the photosensitive drum 81 rotates, while being charged across its peripheral surface by the charge roller 82. Then, a beam of laser light is projected upon the peripheral surface of the photosensitive drum 81 while being modulated with the information of the image to be formed. Consequently, an electrostatic latent image is formed on the peripheral surface of the photosensitive drum 81. Then, toner is adhered to this electrostatic latent image. As a result, the electrostatic latent image is developed into a visible image formed of toner (which hereafter may be referred to as toner image). Then, the toner image is transferred onto the intermediary transfer belt 44*b*.

Meanwhile, the feed roller 32 rotates, in parallel to the progression of the operation for forming the toner image, to feed the topmost sheet S of recording medium in the sheet cassette 31, while separating the sheet S from the rest in the cassette 31, into the apparatus main assembly 10. Then, the sheet S is conveyed to the secondary transferring portion 45 by way of the sheet conveyance passage, with such timing that it reaches the secondary transferring portion 45 at the same time as the toner image on the intermediary transfer belt 44*b*. In the secondary transferring portion 45, the toner image on the intermediary transfer belt 44*b* is transferred onto the sheet S. Then, the sheet S is conveyed to the fixing apparatus 46, in which the unfixed toner image is heated and pressed. Consequently, the unfixed toner image becomes fixed to the surface of the sheet S. Then, the sheet S is discharged from the apparatus main assembly 10 by the pair of discharge rollers 61 through the sheet discharge opening 10*a*, into the delivery tray 62 in such a manner that it will be laid upon the layered sheets S in the delivery tray 62.

Figure 5:
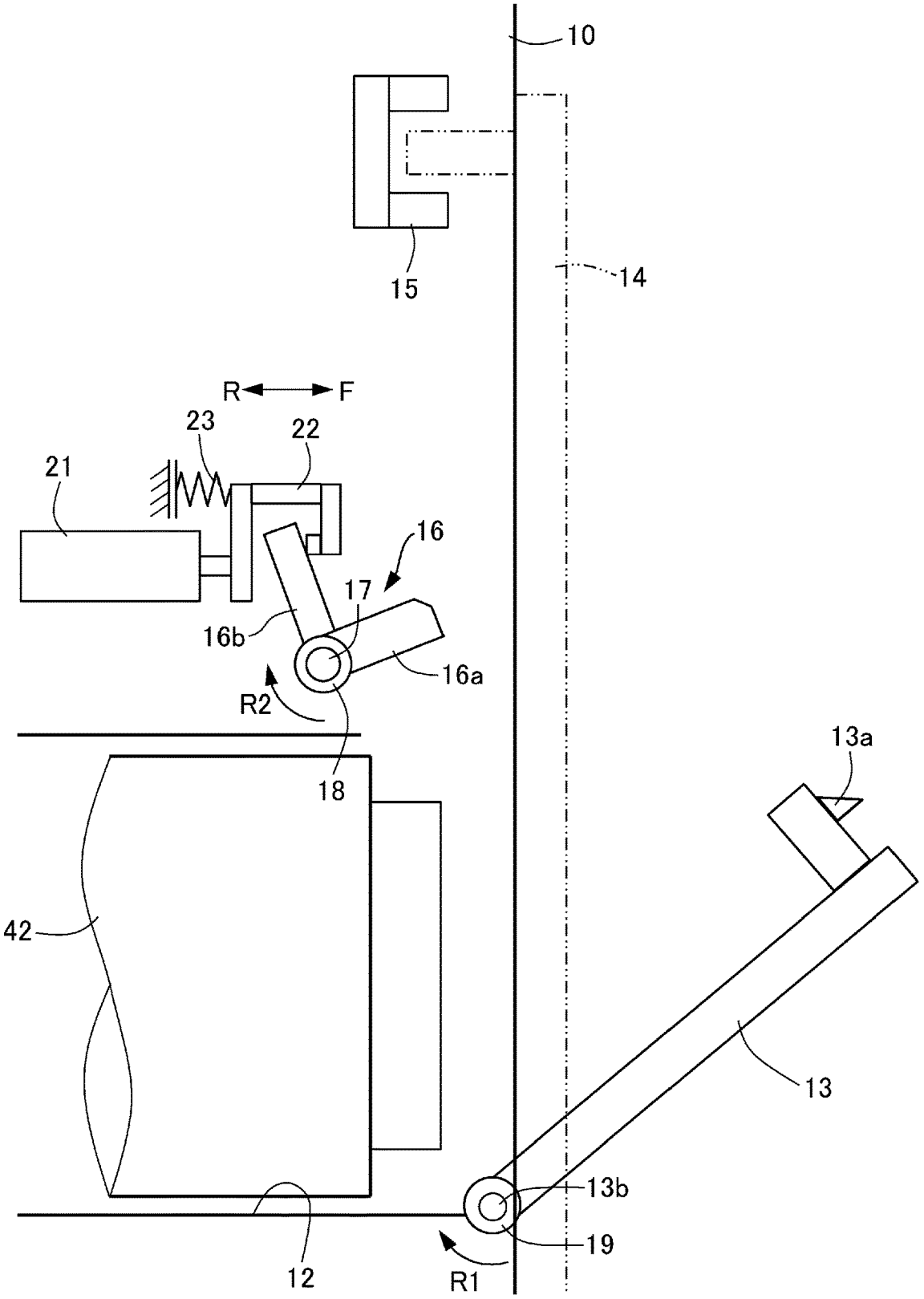
FIG. 5 is a schematic side view of one of the inside covers of the image forming apparatus in the first embodiment, when the front cover of the apparatus is open.

Next, the inside covers 13 and front cover 14 are described in detail about their structure. Referring to FIGS. 4 and 5, while the front cover 14 remains closed (contoured by imaginary line), a part of the top portion of the front cover 14 is detected by the opening/closing sensor 15. That is, the opening/closing sensor 15 is capable of detecting the state (whether front cover 14 is open or closed) of front cover 14.

The inside cover 13 prevents the toner container 42 from being inserted into, or extracted from, the compartment 12 for the toner container 42, by remaining closed. The inside cover 13 is provided with a claw 13*a* which is upwardly protrusive from the top edge of the inside cover 13. The claw 13*a* is given such a shape that when the inside cover 13 is remaining closed as shown in FIG. 4, its surface facing the frontward direction F is vertical, and its surface facing the rearward R is slanted. The inside cover 13 is pivotally movable about a shaft 13*b*, with which the bottom portion of the inside cover 13 is provided. It is always under the pressure generated by spring 19 (torsional coil spring) in the direction indicated by an arrow mark R1. That is, it remains pressured in the opening direction.

The apparatus main assembly 10 is provided with a latch 16 (locking means) attached to the portion of the apparatus main assembly 10, which will be near the claw 13*a* of the inside cover 13 when the inside cover 13 is remaining closed as shown in FIG. 4. The latch 16 has: an engaging portion 16*a* which is capable of engaging with the claw 13*a* of the inside cover 13 as the inside cover 13 is closed; and a contact portion 16*b* which is pressed in the front-to-rear direction by a solenoid. The latch 16 is pivotally movable about a shaft 17, with which the apparatus main assembly 10 is provided. The latch 16 is always kept pressed in the rotational direction indicated by an arrow mark R2 by a spring 18 (torsional coil spring). Thus, the latch 16 is capable of keeping the inside cover 13 locked in the closed state. The apparatus main assembly 10 is provided with a solenoid 21, and a link 22 which is in connection to the solenoid 21. The link 22 is movable frontward or rearward. It remains pressured in the frontward direction indicated by the referential code F by a return spring 23 (compression coil spring). It is positioned so that it can be contacted by the contacting portion 16*b* of the latch 16.

When the inside cover 13 is kept in the closed state, the solenoid 21 is kept turned off, and the link 22 remains in its frontward position by being pressed in the frontward direction F by the return spring 23. Further, the latch 16, which is remaining pressured in the rotational direction R2 by the spring 18, remains engaged with the claw 13*a* by its engaging portion 16*a*, locking the inside cover 13 in the closed state to prevent the inside cover 13 from being opened in the rotational direction R1 by the spring 19. Since the vertical surface of the claw 13*a* faces in the frontward direction F, it is assured that the inside cover 13 is prevented from being opened in the rotational direction R1 by the spring 19.

Referring to FIG. 5, as the solenoid 21 is turned on, the link 22 is moved in the rearward direction R against the return spring 23, and presses the contacting portion 16*b* of the latch 16, causing the latch 16 to move in the opposite direction from the rotational direction R2 against the resiliency of the spring 18. As a result, the engaging portion 16*a* disengages from the claw 13*a*, allowing the inside cover 13 to be opened in the rotational direction R1 by the return spring 19. That is, the control portion 70 allows the inside cover 13 to open by unlocking the latch 16 by turning on the solenoid 21. In this embodiment, a combination of the spring 19 and latch 16 is equivalent to a releasing means, and is capable of allowing the inside cover 13 to be changed in state from remaining closed to remaining open.

Further, the open inside cover 13 can be closed by a user by pressing the inside cover 13 in the opposite direction from the rotational direction R1. As the inside cover 13 is rotated in the closing direction, the claw 13*a* of the inside cover 13 pushes the engaging portion 16*a* of the latch 16 upward against the spring 18, so that the inside cover 13 pivotally moves. Since the slanted surface of the claw 13*a* faces in the rearward direction R, the engaging portion 16*a* can be rotationally pushed upward by the slanted surface, against the spring 18. As the claw 13*a* is pushed into the point of engagement (FIG. 4) between the claw 13*a* and engaging portion 16*a*, the engaging portion 16*a* is rotated to the position shown in FIG. 4 by the spring 18, and engages the claw 13*a*. By the way, this embodiment is not intended to limit the present invention in the structural arrangement for opening or closing the inside cover 13, and the structural arrangement for locking the inside cover 13 in the closed state. Needless to say, the present invention is compatible with any of the known structural arrangements, or a new one, for opening or closing of the inside cover 13.

Figure 6:
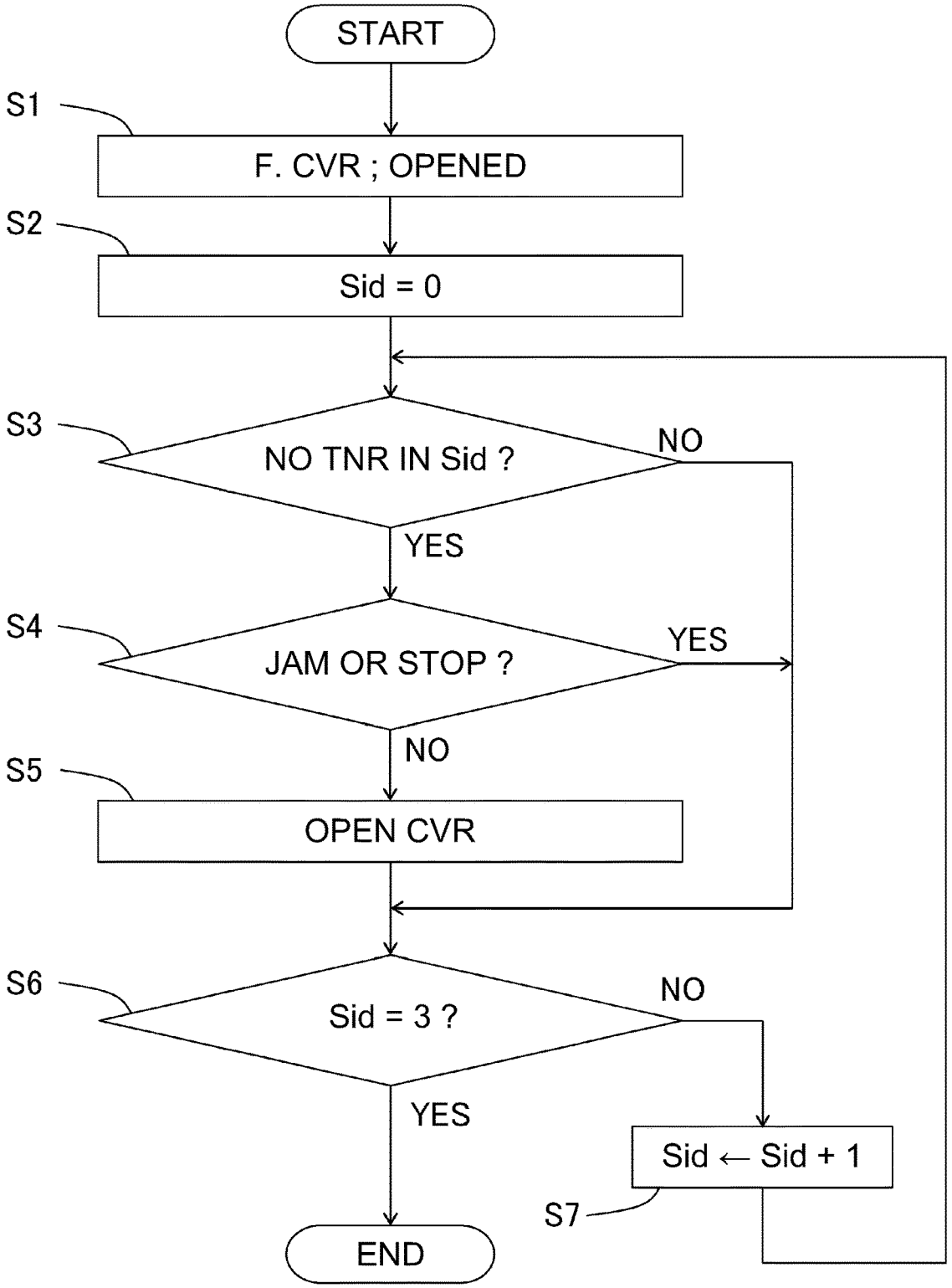
FIG. 6 is a flowchart of the operational sequence of the image forming apparatus in the first embodiment, which occurs as the front cover of the apparatus is opened.

Next, referring to the flowchart in FIG. 6, the sequential steps which the control portion 70 of the image forming apparatus 1 described above follows are described. As it is detected by the opening/closing sensor 15 that the front cover 14 has just been opened (Step S1), the CPU 71 stores "0" in Sid (step S2). "Sid" is equivalent to a color "id" for each toner container 42. If the color of given toner is yellow, Sid is set to zero (Sid=0); magenta, 1 (Sid=1); cyan, 2 (Sid=2); and if it is black, Sid is set to 3 (Sid=3).

The CPU 71 determines whether or not each of the toner containers 42 is out of toner (step S3), based on the value of the out-of-toner flag stored in the RAM 73. If the CPU 71 determines that the toner container 42, the color code of which is Sid, is out of toner (YES in step S3), it determines the state of operation of the apparatus main assembly 10. Here, the CPU 71 determines whether or not the image forming apparatus 1 is suffering from a paper jam, and also, whether or not the image forming apparatus 1 is in the middle of the image forming job (step S4).

If the CPU 71 determines that the image forming apparatus 1 is not suffering from a paper jam, or is not in the middle of the image formation job (NO in step S4), the CPU 71 carries out the operation for opening the inside cover 13 which corresponds to Sid (step S5). That is, the CPU 71 is capable of carrying out the operation for opening the inside cover 13, with the use of the spring 19, when the closed front cover 14 is opened when the residual amount of the toner in a given toner container is no more than a preset amount. That is, the inside cover 13 which corresponds to the toner container which is out of toner is opened. Therefore, it is assured that a user recognizes the toner container 42 which is out of toner, and replaces it, without taking a toner container 42 which is not out of toner, for the one which is out of toner.

Further, if the CPU 71 determines that whether Sid is 3 (Step S6). If it determines that Sid is 3 (YES in step S6), it determines that the judgment was made for all the toner containers 42. Therefore, it ends the sequence. Further, if the CPU 71 determines that Sid is not 3 (NO in step S6), it increases Sid by 1 (step S7), and carries out step S3 again.

On the other hand, if the CPU 71 determines in step S3 that the toner container 4, the color of the toner therein is indicated by Sid, is not out of toner (NO in step S3), it determines that the toner container 42 contains a sufficient amount of toner, that is, this toner container 42 does not need to be replaced. Therefore, it determines whether or not Sid is 3 (step S6), without opening the inside cover 13 which corresponds to this toner container 42.

Further, if the CPU 71 determines in step S4 that the image forming apparatus 1 is suffering from a paper jam, or the image forming apparatus 1 is in the middle of an image formation job (YES in step S4), the CPU 71 determines the reason why a user opened the front cover 14 is for carrying out an operation other than the one for replacing a toner container 42. That is, in a case where a toner container 42 is out of toner, and the image forming apparatus 1 is suffering from a paper jam, the CPU 71 determines that a user opened the front door 14 to deal with the paper jam. However, in a case where the front cover 14 is opened while a toner container 42 is out of toner, and the image forming apparatus 1 is suffering from a paper jam, the CPU 71 determines that a user opened the front door 14 to deal with the paper jam. In a case where the front cover 14 is opened while an image formation job is carried out, the CPU 71 determines that the front cover 14 was accidentally opened, including an unexpected reason. In either case, therefore, the control portion 70 determines that a user did not open the front cover 14 to replace a toner container 42 which is out of toner. That is, while the image forming apparatus 1 is suffering from a paper jam, or carrying out an image forming job, even if the front door 14 is opened because the residual amount of toner in a toner container 42 is smaller than a preset value, the control portion 70 does not allow the spring 19 to open the inside cover 13.

By the way, in this embodiment, in a case where at least one of the toner containers 42 which are not for black toner is no more than a preset value in the residual amount of toner therein, the control portion 70 puts the image forming apparatus 1 in the monochromatic mode in which the image forming apparatus 1 forms only a black toner image with the use of black toner. Further, in a case where the image forming apparatus 1 is suffering from a paper jam or carrying out an image forming job in the monochromatic mode and the residual amount of toner in one of the toner containers 42 which are not for black toner is no more than a preset value in the residual amount of toner therein, the control portion 70 does not allow the spring 19 to open the inside cover 13 even if the front cover 14 is opened. On the other hand, in a case where the image forming apparatus 1 is suffering from a paper jam, or carrying out an image forming job in the monochromatic mode, and the residual amount of toner in one of the toner containers 42 which are not for black toner is no more than a preset value in the residual amount of toner therein, it is impossible for the image forming apparatus 1 to form an image, and therefore, the control portion 70 stops the ongoing image forming operation. Further, it releases the inside cover 13 for the toner container 42 for black toner to make it possible for the toner container 42 to be replaced. Replacing the toner container 42 for black toner makes it possible to continue the interrupted image forming operation.

As described above, in this embodiment, in a case where the front cover 14 is opened while the image forming apparatus 1 is suffering from a paper jam, or carrying out an image forming operation, the control portion 70 of the image forming apparatus 1 does not allow the spring 19 to open the inside cover 13, even if the residual amount of toner in one of the toner containers 42 is no more than a preset value. Therefore, it can prevent the problem that when a user opens the front cover 14 for a purpose other than replacing a toner container 42, the user erroneously replaces a toner container 42 which does not need to be replaced. Further, it can eliminate the operation for closing an automatically opened inside cover 13. That is, it can simplify the operation for replacing a toner container 42. As described above, if the front cover 14 is opened while the image forming apparatus 1 is suffering from a paper jam, the control portion 70 determines that the opening of the front cover 14 is not intended for the replacement of a toner container 42, and therefore, it does not allow the inside cover 13 to open, even if one or more of the toner containers 42 are out of toner. That is, this embodiment can provide an image forming apparatus 1 which does not require a user to perform an extra job when the user opens the front cover to perform a specific job.

The image forming apparatus 1 in this embodiment is structured so that the inside cover 13 remains under the pressure generated by the spring 19 in the direction to open the inside cover 13, and the control portion 70 allows the inside cover 13 to open, by releasing the lock of the latch 16. That is, the control portion 70 can release the lock of the latch 16 by turning on the solenoid 21 by supplying the solenoid 21 with electric power. Therefore, the image forming apparatus 1 is substantially simpler than any conventional one, in terms of the controlling of the inside cover 13.

By the way, in the case of the image forming apparatus 1 in this embodiment described above, the residual amount of toner in the toner container 42 is detected by the toner density sensor 85. This embodiment, however, is not intended to limit the present invention in scope in terms of the means by which the residual amount of toner in the toner container 42 is detected. For example, the present invention is also compatible with an image forming apparatus structured so that the toner hopper 41 is provided with a storage container for storing the toner discharged from the toner container 42, and one of side walls of the storage container is provided with the residual amount detection sensor 48 (residual amount detecting means) (FIG. 3). In this case, the residual amount sensor 48 is a piezoelectric sensor, which can detect the information regarding the residual amount of toner in the toner container 42 by detecting the height of the body of toner in the container by using the phenomenon that its output voltage is affected by the presence or absence of toner in the adjacencies of its surface.

Embodiment 2

Figure 7:
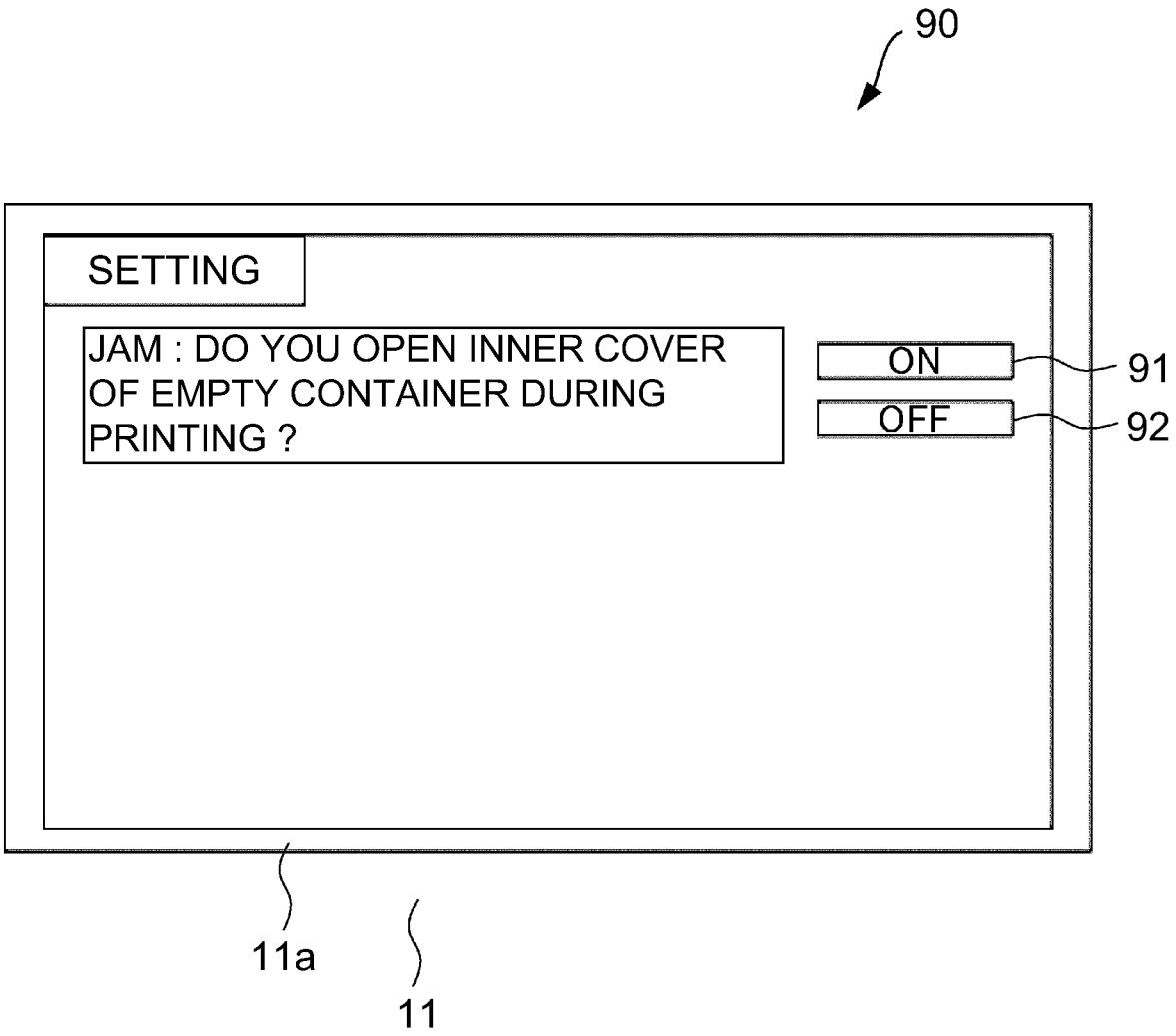
FIG. 7 is a schematic drawing of the image which is to be displayed on the monitor of the image forming apparatus in the second embodiment, in order to allow a user to set the operational sequence to be carried out as the front cover is opened.
Figure 8:
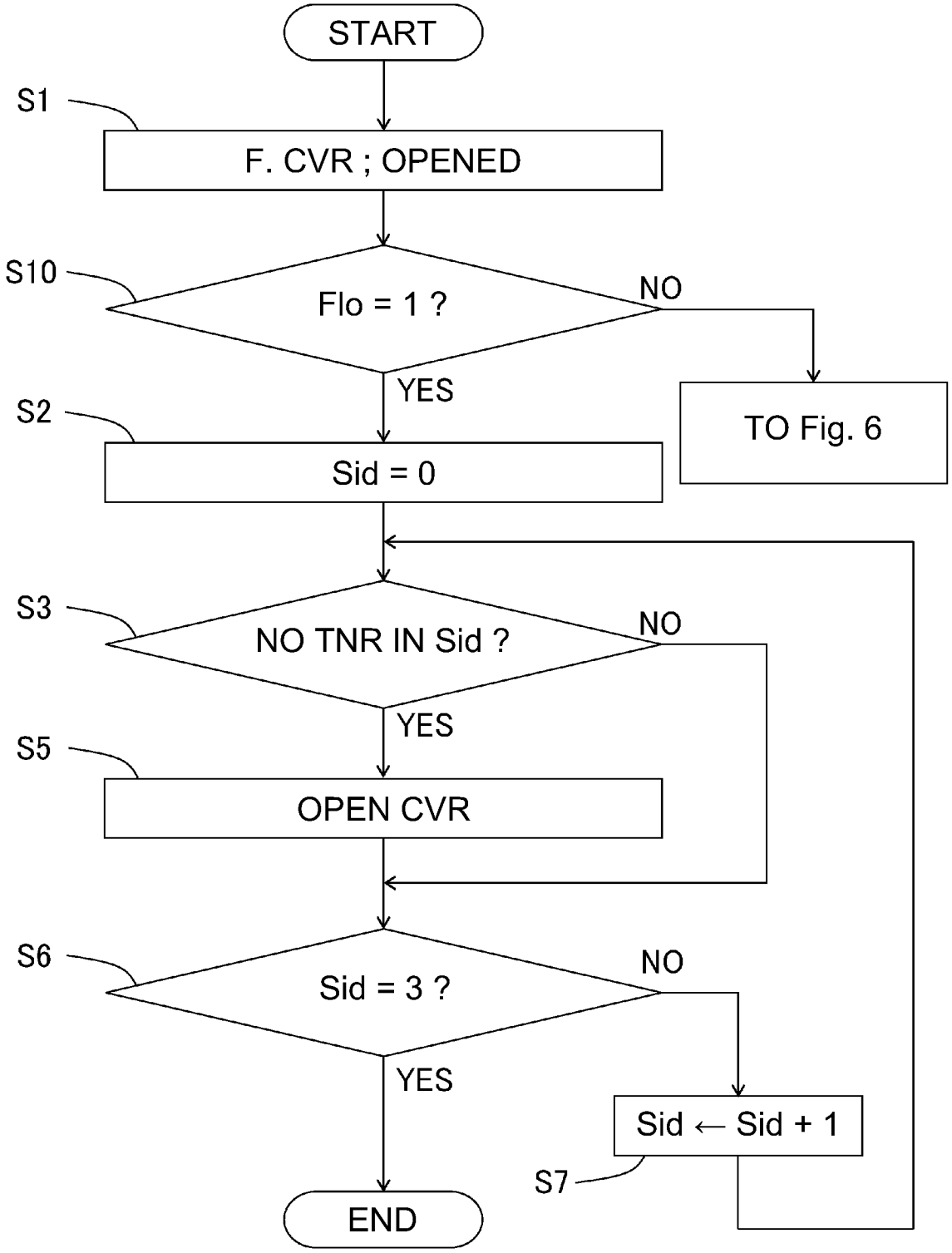
FIG. 8 is a flowchart of the operational sequence of the image forming apparatus in the second embodiment, which is to be carried out when the front cover of the apparatus is opened.

Next, referring to FIGS. 7 and 8, the second embodiment of the present invention is described in detail. This embodiment is different from the first one in that the image forming apparatus 1 in this embodiment can be switched in operation between the one in which the apparatus main assembly 10 is judged in the state of operation, and the one in which the apparatus main assembly 10 is not judged in the state of operation, based on the setting inputted in advance, while the toner container 42 is out of toner, and the front cover 14 is open. Here, the judgement of the apparatus main assembly 10 in the state of operation is to determine whether the image forming apparatus 1 is suffering from a paper jam, or is in the middle of an image formation job. Otherwise, this embodiment is the same as the first embodiment, and the structural components, and the portions thereof, of the image forming apparatus 1 in this embodiment are given the same referential codes as those given to the counterparts in the first embodiment, and are not described in detail. By the way in this embodiment, the control portion 70 is equivalent to a setting portion through which the image forming apparatus 1 can be set so that it opens the inside cover 13 or not.

Referring to FIG. 7, in this embodiment, whether the inside cover 13 is to be opened or not when a toner container 42 is out of toner can be set with the use of a graphic displayed across the touch panel 11*a* of the control panel 11. That is, if an ON button 91 in the graphic is pressed by a user, the CPU 71 stores "1" in the variable F1 of the lock determination flag provided in the RAM 73. In this case, the inside cover 13 is allowed to open even when the image forming apparatus 1 is suffering from a paper jam, or is carrying out an image formation job. On the other hand, if an OFF-button (non-execution) is pressed by a user, the CPU 71 stores "0" in the lock determination variable F1. In this case, when the image forming apparatus 1 is suffering from a paper jam, or is carrying out an image forming job, the CPU 71 does not allow the inside cover 13 to be opened, even when a toner container 42 is out of toner.

Next, the operational steps to be carried out when the front cover 14 of the image forming apparatus 1 in this embodiment described above is opened is described, with reference to the flowchart in FIG. 8. By the way, if an operational step in the flowchart in FIG. 8 is similar to an operational step in the flowchart in FIG. 6, the former is given the same referential code as the latter, and may sometimes not be described.

As the opening/closing sensor 15 detects that the front cover 14 has just been opened (step S1), the CPU 71 determines whether or not the value of the variable Flo of the lock determination flag is 1 (Flo=1) (step S10). If the CPU 71 determines that the value of the variable F1 of the lock determination flag Flo is not 1, that is, Flo=0 (NO in step S10), it does not allow the inside cover 13 to be released while the image forming apparatus 1 is suffering from a paper jam, or during an image formation job. In this case, therefore, the CPU 71 follows the flowchart in FIG. 6. That is, in a case where it was set by the control portion 70 not to release the inside cover 13, the operation to release the inside cover 13 by the spring 19 is not carried out even if the residual amount of toner in the toner container 42 is no more than a preset value.

On the other hand, it the CPU 71 determines that the variable Flo of the lock determination flag is 1 (Flo=1) (YES in step S10), it stores "0" in Sid (step S2), and determines whether or not the toner container 42, which contains the toner having the color indicated by Sid, is out of toner (step S3). If the CPU 71 determines that the toner container 42, which contains the toner, the color of which is indicated by Sid, is out of toner (YES in step S3), it allows the inside cover 13 for the compartment for the toner container 42 which contains the toner, the color of which is indicated by Sid, to be released, without determining the state of operation of the apparatus main assembly 10 (Step S5). That is in a case where the image forming apparatus 1 is set by the control portion 70 so that the inside cover 13 is allowed to be released, the CPU 71 allows the inside cover 13 to be released by the spring 19, if the front cover 14 is opened when the residual amount of toner in the toner container 42 is no more than a preset value. Thus, even if the image forming apparatus 1 is suffering from a paper jam, or carrying out an image formation job, the inside cover 13 for the toner container 42 which is out of toner is released. Therefore, a user is prompted to replace the toner container 42 which is out of toner. In addition, the CPU 71 determines whether or not Sid is 3 (step S6). The operational steps taken by the CPU 71 thereafter are the same as those of the flowchart in FIG. 6, and therefore, are not described in detail.

On the other hand, if the CPU 71 determines in step S3 that the toner container 42 which contains the toner having the color indicated by Sid is not out of toner (NO in step S3), it determines that this toner container 42 contains a sufficient amount of toner, that is, this toner container 42 does not need to be replaced. Then, the CPU 71 determines whether or not Sid is 3 (step S6).

Even the image forming apparatus 1 described above can be set by its control portion 70 so that if the front cover 14 is opened while the image forming apparatus 1 is suffering from a paper jam, or is carrying out an image formation job, the CPU 71 does not allow the inside cover 13 to be opened by the spring 19, even if the residual amount of toner in the toner container 42 is no more than a preset value. Therefore, it is possible to prevent the problem that when the front cover 14 is opened during an operation other than the one for replacing a toner container 42, a user erroneously replaces a toner container 42 which does not need to be replaced. That is, it is possible to eliminate the operation for closing an automatically opened inside cover 13. That is, it is possible to simplify the operation for dealing with a paper jam or the like.

Further, this image forming apparatus 1 can be set so that the inside cover 13 for the compartment for a toner container 42 which is out of toner is allowed to open, even while the image forming apparatus 1 is suffering from a paper jam, or during an image formation job. Therefore, it is ensured that a user replace the toner container 42 which is out of toner. In other words, this embodiment can improve an image forming apparatus in terms of the efficiency with which a user can deal with a paper jam or the like.

Figure 9:
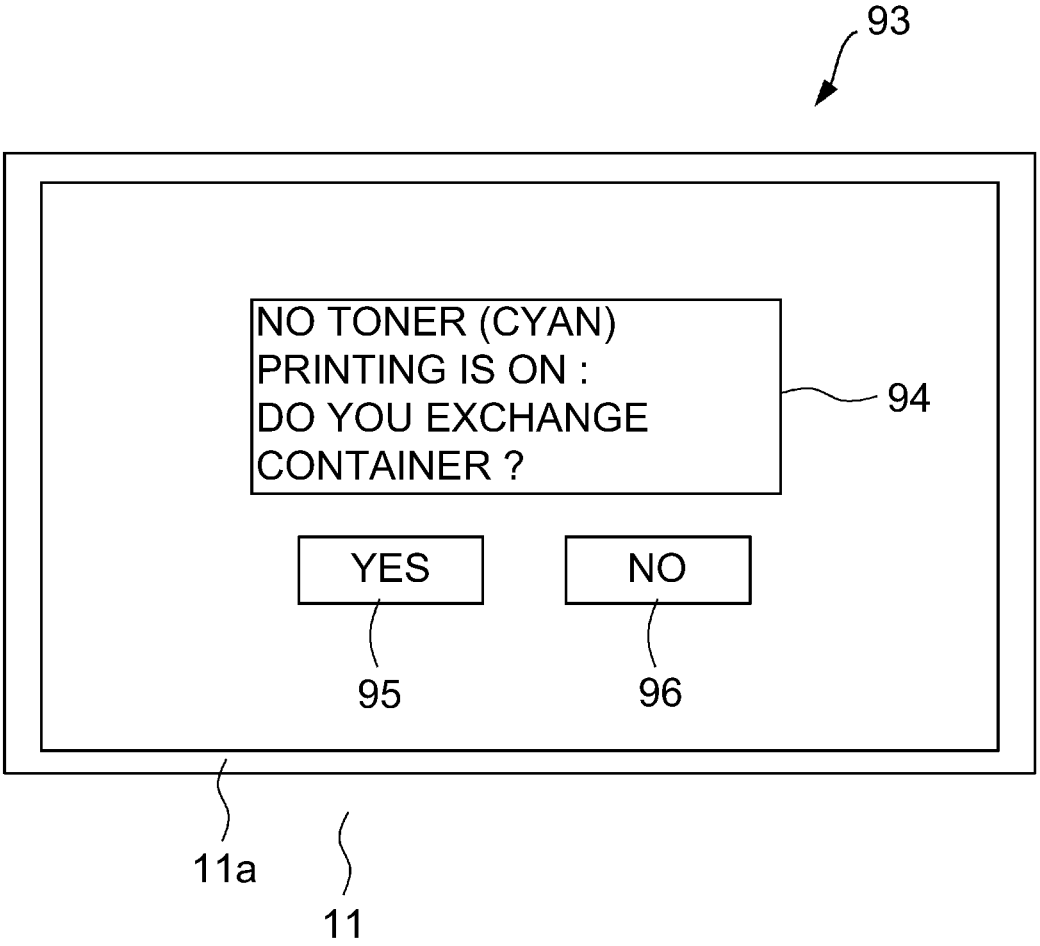
FIG. 9 is a schematic drawing of the image to be displayed across the monitor of the image forming apparatus in the second embodiment, as the front cover of the apparatus is opened.

In the case of the image forming apparatus 1 in this embodiment described above, if its front cover 14 is opened, and it is determined that the toner container 42 which contains the toner, the color of which is indicated by Sid, is out of toner, the lock for the inside cover 13 is immediately released (step S5). This embodiment, however, is not intended to limit the present invention in scope in terms of the releasing of the lock of the inside cover 13. For example, the image forming apparatus 1 may be designed so that if it is determined that the toner container 42, which contains the toner, the color of which is indicated by Sid, is out of toner (YES in step S3), a message is displayed on the screen 11*a* of the control panel 11. An example of the message is the graphic 93 shown in FIG. 9, which is for a user to choose, or not to choose, to allow the inside cover 13, which corresponds to the toner container 42 which is out of toner, to open, so that a user can choose to, or not to, allow the inside cover 13 to open.

That is, if the front cover 14 is opened while the image forming apparatus 1 is suffering from a paper jam or the image forming apparatus 1 is in the middle of an image formation job, and the residual amount of toner in one or more of the toner containers 42 is no more than a preset value, the control portion 70 displays a graphic having an rectangle area 94 which informs a user that it is time to replace the toner container 42. If the information inputted by a user through the control panel is information 95 that indicates that a user wants to replace the toner container 42, the control portion 70 allows the inside cover 13 to be opened by the spring 19. On the other hand, in a case where the information inputted by a user is such information 96 that a user does not want to replace the toner container 42, the control portion 70 does not allow the inside cover 13 to be opened by the spring 19.

Further, the image forming apparatus 1 may be set so that the sequence for determining whether or not the inside cover 13 is to be kept locked is carried out only in such a monochromatic mode in which the image forming apparatus 1 is put when one of the three toner containers 42 which contain yellow, magenta, and cyan toners, one for one, is out of toner, because it is unlikely to be thought to replace a toner container 42 which contains color toner while the image forming apparatus 1 is operated in the monochromatic mode.

The image forming apparatuses in the preceding embodiments were provided with the inside cover 13 which allows or prohibits the extraction of a toner container 42. As an example of this type of structural arrangement for the image forming apparatus 1, the image forming apparatus 1 may be structured as follows: the image forming apparatus 1 may be provided with a locking mechanism for keeping toner containers 42 locked to the image forming apparatus 1, instead of providing the apparatus main assembly 10 with the inside doors 13, so that the locking mechanism allows or prohibits the extraction of the toner container 42. The locking mechanism is structured so that when the image forming apparatus 1 is set to allow a toner container to be replaced, it allows the toner container to automatically come out of the toner container compartment in the frontward direction of the apparatus main assembly 10. This type of structural arrangement also can control the outward movement of the toner container 42 like the inside cover 13 in the preceding embodiments, and therefore, can provide the same effects as those given by the preceding embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-118260 filed on Jun. 21, 2018, which is hereby incorporated by reference herein in its entirety.

What is claimed is:

1. An image forming apparatus comprising:

a plurality of developer accommodating containers including a chromatic developer accommodating container and a black developer accommodating container;

a plurality of mounting portions configured to mount said developer accommodating containers, respectively;

an image forming portion configured to form an image on a recording material;

a switching portion configured to switch a state between a first state in which said developer accommodating containers mounted in said mounting portions are capable of being dismounted and a second state in which said developer accommodating containers are not capable of being dismounted; and a manually openable and closable cover provided on an outside of said image forming apparatus, wherein said plurality of mounting portions become accessible by opening of said cover, i) in a stand by state in which said image forming apparatus is waiting for input of an image formation signal and exchange of at least one of said developer accommodating containers mounted in said mounting portion is prompted, said switching portion switches the state from the second state to the first state in response to an opening operation of said cover, and ii) in a state in which a jam occurrence signal is ON and the exchange of said at least one developer accommodating container mounted in said mounting portion is prompted, said switching portion maintains the second state without switching from the second state to the first state irrespective of the opening operation of said cover.

2. The apparatus according to claim 1, further comprising accommodating portion covers provided for respective mounting portions and configured to open and close respective entrance openings through which said developer accommodating containers can be mounted and dismounted, wherein said switching portion opens at least one of said accommodating portion covers in the first state and closes at least one of said accommodating portion covers in the second state.

3. The apparatus according to claim 1, wherein said image forming portion permits an image forming operation for monochromatic black image formation even if the exchange of said chromatic developer accommodating container mounted in said mounting portion is prompted.

4. The apparatus according to claim 1, further comprising a display portion for displaying information prompting exchange of said developer accommodating containers mounted in said mounting portions.

5. The apparatus according to claim 1, further comprising an input portion configured to carry out a switching operation from the second state to the first state in a state in which the exchange of at least one of said developer accommodating containers mounted in said mounting portion is prompted.

6. The apparatus according to claim 5, wherein in a state in which the jam occurrence signal is ON and the exchange of said at least one developer accommodating container mounted in said mounting portion is prompted, said switching portion switches the state from the second state to the first state based on an operation of said input portion.

7. The apparatus according to claim 1, wherein in a state that said switching portion maintains the second state without switching from the second state to the first state, the jam occurrence signal changes to OFF from ON, and said image forming apparatus is waiting for input of the image formation signal, said switching portion switches the state from the second state to the first state in response to the opening of said cover.

8. The apparatus according to claim 2, further comprising a locking mechanism configured to lock said mounting portion covers, wherein in the second state, said locking mechanism locks said mounting portion covers to prevent opening of said mounting portion covers.

9. The apparatus according to claim 1, further comprising a setting portion configured to set whether to switch the state from the second state to the first state in a case in which said image forming apparatus is waiting for input of the image formation signal and exchange of said at least one developer accommodating container mounted in said mounting portion is prompted in response to the opening operation of said cover.

10. The apparatus according to claim 1, further comprising a setting portion configured to set whether to switch the state from the second state to the first state in a case in which the jam occurrence signal is ON and exchange of said at least one developer accommodating container mounted in said mounting portion is prompted in response to the opening operation of said cover.

* * * * *